US007666039B2

(12) United States Patent
Zelm et al.

(10) Patent No.: US 7,666,039 B2
(45) Date of Patent: Feb. 23, 2010

(54) OUTBOARD MOTOR STEERING ASSEMBLY WITH RUDDER REFERENCE SENSOR

(75) Inventors: Gerald Allen Zelm, Menomonie, WI (US); James Dennis Cayford, Afton, MI (US)

(73) Assignee: Marinetech Products, Inc., White Bear Lake, MN (US)

( * ) Notice: Subject to any disclaimer, the term of this patent is extended or adjusted under 35 U.S.C. 154(b) by 19 days.

(21) Appl. No.: 11/983,530

(22) Filed: Nov. 9, 2007

(65) Prior Publication Data

US 2008/0113571 A1 May 15, 2008

Related U.S. Application Data

(60) Provisional application No. 60/858,629, filed on Nov. 13, 2006.

(51) Int. Cl.
*B63H 5/125* (2006.01)
*B63H 20/08* (2006.01)
*B63H 5/20* (2006.01)

(52) U.S. Cl. ..... 440/60; 53/58

(58) Field of Classification Search ..... 114/144 R, 114/144 RE, 144 A, 154–161; 440/53, 55, 440/58–60, 61 S, 63; 318/588
See application file for complete search history.

(56) References Cited

U.S. PATENT DOCUMENTS 3,121,415 A 2/1964 Anderson et al.
3,283,738 A * 11/1966 Nelsen ..... 440/59
4,300,888 A 11/1981 Warning
4,373,920 A 2/1983 Hall et al.
4,909,765 A 3/1990 Riske et al.
5,029,547 A 7/1991 Novey
5,179,905 A 1/1993 Hossfield et al.
5,214,363 A * 5/1993 Wisner et al. ..... 318/588
5,240,445 A 8/1993 Aoki et al.
5,626,502 A 5/1997 Novey
6,264,514 B1 7/2001 Lueras
7,404,369 B2 * 7/2008 Tracht et al. ..... 114/144 RE
2006/0019558 A1 1/2006 Mizutani et al.

* cited by examiner

*Primary Examiner*—Daniel V Venne
(74) *Attorney, Agent, or Firm*—Howson & Howson LLP

(57) ABSTRACT

An outboard motor having a steering control and a rudder reference sensor, both connectible to a computer-operated guidance system. The steering control utilizes a linear actuator connected through a linkage to the motor. The actuator utilizes a rack that moves along the axis about which the motor pivots from its use position to its storage position, thereby enabling the rudder position sensor to remain connected to the motor when the motor is pivoted from its use position to its storage position. The sensor can include a follower disposed in a sloping groove on the rack, a pin on the rack engaged in a helical groove on a cylinder, or an externally mounted sensor connected to the steering linkage through an auxiliary linkage.

4 Claims, 11 Drawing Sheets

OUTBOARD MOTOR STEERING ASSEMBLY WITH RUDDER REFERENCE SENSOR

CROSS-REFERENCE TO RELATED APPLICATION

This application claims priority from Provisional Patent application 60/858,629, filed Nov. 13, 2006.

FIELD OF THE INVENTION

This invention relates to steering assemblies that can be used to steer outboard motors attached to the stern of a boat and used to propel the boat, and more particularly to steering assemblies that include a rudder reference sensor, or motor position indicator, that can provide a different electrical signal for each position to which the rudder and propeller of the outboard motor can be rotated with respect to the stern of the boat.

BACKGROUND OF THE INVENTION

Steering assemblies are known that can be used to steer inboard/outboard or outboard motors attached to the stern of a boat and used to propel the boat, which steering assemblies include a rudder reference sensor including a variable resistance potentiometer that can provide a different electrical signal for each position to which the rudder and propeller of the outboard motor or outboard portion of the inboard/outboard can be rotated with respect to the stern of the boat. That signal from the rudder reference sensor is sent to a known type of computer-operated guidance system on the boat that can attempt to keep the boat traveling along a desired directional heading by determining the actual heading of the boat and, if that actual heading is not the same as the desired heading, can determine an appropriate direction and amount to rotate the rudder and propeller of the outboard motor or outboard portion of the inboard/outboard in an attempt to correct the heading of the boat . Then, based on that determination, the guidance system can operate the steering mechanism to position the rudder and propeller of the outboard motor or outboard portion of the inboard/outboard motor so that it will change the heading of the boat toward or to the desired heading.

Known rudder reference sensors, (e.g., the Raymarine E15022 "Rotary Rudder Reference Bracket", model 5915368, or the Raymarine M81188 Linear Rudder Reference sensor for outboards, model 251251, both of which are commercially available from West Marine, Watsonville, Calif.) while suitable for use with inboard/outboard type drive systems, are not easily adaptable for use with small horsepower outboard motors (e.g., 5 to 10 h. p.) used to propel fishing boats at slow speeds (e.g., 1 to 3 m.p.h.) while trolling for fish. A major portion of such an outboard trolling motor including its rudder and propeller is typically pivoted over about 40 degrees between a use position with the rudder and propeller of the outboard motor under the water where it can propel the boat during trolling, and a storage position with all of the outboard motor including its rudder and propeller above the water surface where they will not interfere with operation of the boat at high speed by a main drive system on the boat. The known way in which commercially available rudder reference sensors are used to indicate the position of such outboard motors is to connect the rudder reference sensor to the outboard motor only when the outboard motor is in its use position, and then disconnect the rudder reference sensor from the outboard motor before the outboard motor is pivoted to its storage position with its rudder and propeller above the water's surface. This can be very inconvenient, particularly when structure at the stern of the boat (e.g., a row of fishing rods in sockets) limits access to the outboard motor.

DISCLOSURE OF THE INVENTION

This invention provides an electrically operated steering assembly for an outboard motor including a cylindrical tube having an axis co-axial with a pivot axis of the outboard motor about which pivot axis a major portion of the outboard motor, including its rudder and propeller, is typically pivoted, through an angle of about 40 degrees, between a use position with the rudder and propeller of the outboard motor under the water where they can steer and propel the boat, and a storage position with all of the outboard motor, including its rudder and propeller, above the water surface; which steering assembly includes a rudder reference sensor and attaches to the outboard motor in such a way that the major portion of the outboard motor including its rudder and propeller can be pivoted between its use and storage positions without the need to disconnect the rudder reference sensor from the outboard motor.

In the invention, an electrically operated outboard motor steering assembly comprises an outboard motor comprising an engine, a rudder fixed to the engine, and a propeller driven by the engine. The outboard motor is pivotable about a horizontal axis from a use position in which its rudder and propeller are submerged to a storage position in which its rudder and propeller are out of the water, and also pivotable about a steering axis substantially perpendicular to a plane in which the horizontal axis lies. A steering control comprises an actuator linked to the outboard motor, and having an actuator element movable linearly along an axis substantially aligned with the horizontal axis about which the motor is pivotable. A rudder reference sensor provides a unique electrical signal for each rotational position of the outboard motor about the steering axis, and a guidance system connected to receive the electrical signal provided by the rudder reference sensor, is connected to operate the actuator to rotate the outboard motor about the steering axis so that the outboard motor maintains a position corresponding to a predetermined heading. The invention is characterized by the fact that the rudder reference sensor is connected to the actuator both when the outboard motor is in its use position and when the outboard motor is in its storage position.

In a preferred embodiment of the invention, there is provided an outboard motor steering assembly adapted to operate through a cylindrical tube included in the outboard motor that has an axis co-axial with the pivot axis of the outboard motor. The steering assembly comprises an elongate rack having a longitudinal axis and a row of gear teeth along the length of the rack; and a housing assembly including means for mounting the rack on the housing assembly for longitudinal movement relative to the housing assembly between a retracted position and an extended position, with a first end portion of the rack projecting farther from a first end of the housing assembly in its extended position than in its retracted position. The drive assembly includes attachment means adapted for attaching the first end of the housing assembly to one end of the cylindrical tube on the outboard motor, with the first end portion of the rack inside the tube and the longitudinal axis of the rack generally aligned with the pivot axis of the outboard motor, and attachment means at the first end portion of the rack adapted for engagement within the tube with one end portion of a steering linkage connected between the first end of the rack and the major portion of the motor, to cause rotary motion of the rudder and propeller of the outboard motor about an axis normal to a plane in which the pivot axis of the motor lies, upon movement of the rack between its retracted and extended positions. The drive assembly also includes rack drive means including a reversible electric motor mounted on the housing assembly and coupled through gearing to the teeth on the rack for driving the rack in either axial direction through incremental distances between its retracted and extended positions by electrical activation of the motor. The drive assembly further includes a rudder reference sensor or position indicator that can provide a unique electrical signal for any position of the rack between its retracted and extended positions, thereby providing a different electrical signal for each position to which the rudder and propeller of the outboard motor is rotated with respect to the stern of a boat on which the outboard motor is mounted. That different electrical signal can be sent to the known type of computer operated guidance system, such as the guidance system commercially designated the "Smart Pilot System Pack," available from Raymarine Inc., Merrimack, N.H.; the guidance system commercially designated "G-Pilot Series 3380 or 3100, available from Navman, a division of Brunswick Corporation of Lake Forest, Ill.; the guidance system commercially designated "TR1," or "TR1 Gold," available from Nautamatic Marine Systems, Inc. of South Beach, Oreg.; the NorthStar 3300 guidance system, available from NorthStar Marine of Acton, Mass., or other guidance systems that have a NEMA 0813 output. Such guidance systems can attempt to keep the boat traveling along a desired directional heading by determining the actual heading of the boat and, if that actual heading is not the same as the desired heading, can determine an appropriate direction and amount to rotate the rudder and propeller of the outboard motor or outboard portion of the inboard/outboard in an attempt to correct the heading of the boat; and then, based on that determination, can operate the steering mechanism to position the rudder and propeller of the outboard motor or outboard portion of the inboard/outboard motor so that it will change the heading of the boat toward or to the desired heading. During this process the signal from the rudder reference sensor is compared with a signal corresponding to the desired directional heading to produce an error signal which controls the steering mechanism.

The typical rudder reference sensor includes a variable resistance, commonly referred to as a "potentiometer." The potentiometer including a fixed potentiometer portion fixed to the housing assembly and a moveable potentiometer portion mounted for movement on the fixed potentiometer portion between various relative positions, with the potentiometer providing a different resistance at each of those relative positions; and potentiometer adjustment means between the rack and the moveable potentiometer portion for moving the movable potentiometer portion to a unique position with respect to the fixed potentiometer portion for each position of the rack between its retracted and extended positions, in order to produce a unique electrical resistance through the potentiometer for each position of the rack between its retracted and extended positions. The means at the first end portion of the rack adapted for engagement with one end portion of the steering linkage, connected between the first end of the rack and major portion of the motor, allows that steering linkage to rotate relative to the rack about an axis coincident with the pivot axis of the outboard motor when the motor is pivoted between its use position with its rudder and propeller under the water and its storage position with its rudder and propeller above the water's surface. Thus, the outboard motor to which the steering assembly is attached can be pivoted between its use position and storage positions without the need to disconnect the rudder reference sensor.

In one embodiment of the outboard motor steering assembly according to the invention, the potentiometer adjustment means between the rack and the moveable potentiometer portion for moving the movable potentiometer portion to a different position with respect to the fixed potentiometer portion for any position of the rack between its retracted and extended positions to produce a unique electrical resistance through the potentiometer for each position of the rack between its retracted and extended positions is provided by a longitudinally extending groove on the rack, defined by surfaces including a contact surface, which contact surface is at different distances from a fixed longitudinal axis of the rack for each portion of the contact surface along the length of the groove, and a following member mounted on the housing assembly with a first end of the following member contacting the contact surface for movement in a direction normal to the longitudinal axis of the rack. Means are provided for biasing the first end of the following member against the contact surface, as are means coupled between the second end of the following member and the moveable variable resistance potentiometer portion for moving the movable variable resistance portion to produce a different electrical resistance for each position of the following member.

The moveable variable resistance potentiometer portion can be mounted on the fixed potentiometer portion for rotation about an axis in a plane generally parallel to the longitudinal axis of the rack, and the means coupled between the second end of the following member and the moveable variable resistance potentiometer portion can comprise a rotor fixed to the rotatable potentiometer portion and carrying a pin projecting from the rotor at a position spaced from the axis of rotation of the moveable potentiometer portion, and a rotor drive member fixed to the second end of the following member and having a slot defined by parallel surfaces along opposite sides of the pin adapted to engage the pin and rotate the rotor and the movable potentiometer portion through an angle, which will ordinarily be less than 180 degrees, upon movement of the following member between its first and second positions.

In an alternate embodiment of the outboard motor steering assembly according to the invention, the potentiometer adjustment means between the rack and the moveable potentiometer portion for moving the movable potentiometer portion to a different position with respect to the fixed potentiometer portion for any position of the rack between its retracted and extended positions to produce a different electrical resistance through the potentiometer for every position of the rack between its retracted and extended positions is provided by a pin carried by the rack and projecting at a right angle with respect to the longitudinal axis of the rack. The moveable variable resistance potentiometer portion is mounted on the fixed potentiometer for rotation about an axis generally parallel to the longitudinal axis of the rack, and the outboard motor steering assembly including an elongate, generally cylindrical, member mounted on the housing assembly for rotation about an axis coaxial with the axis of rotation for the moveable variable resistance potentiometer portion. One end of the generally cylindrical member is attached to the moveable variable resistance potentiometer portion, and the generally cylindrical member has surfaces defining a helical groove about its periphery. The groove receives an end portion of the pin carried by the rack so that, through contact between the pin carried by the rack and the surfaces defining the groove, movement of the rack will rotate the cylindrical member and thereby rotate the movable potentiometer portion.

Still another embodiment utilizes a linear potentiometer having a follower arm that engages a groove in the rack.

BRIEF DESCRIPTION OF THE DRAWINGS

The invention will be further described with reference to the accompanying drawing wherein like reference numerals refer to like parts in the several views, and wherein.

DETAILED DESCRIPTION

FIGS. 1 through 7 of the drawings illustrate a first embodiment of an outboard motor steering assembly including a rudder reference sensor and steering control according to the invention.

Figure 1:
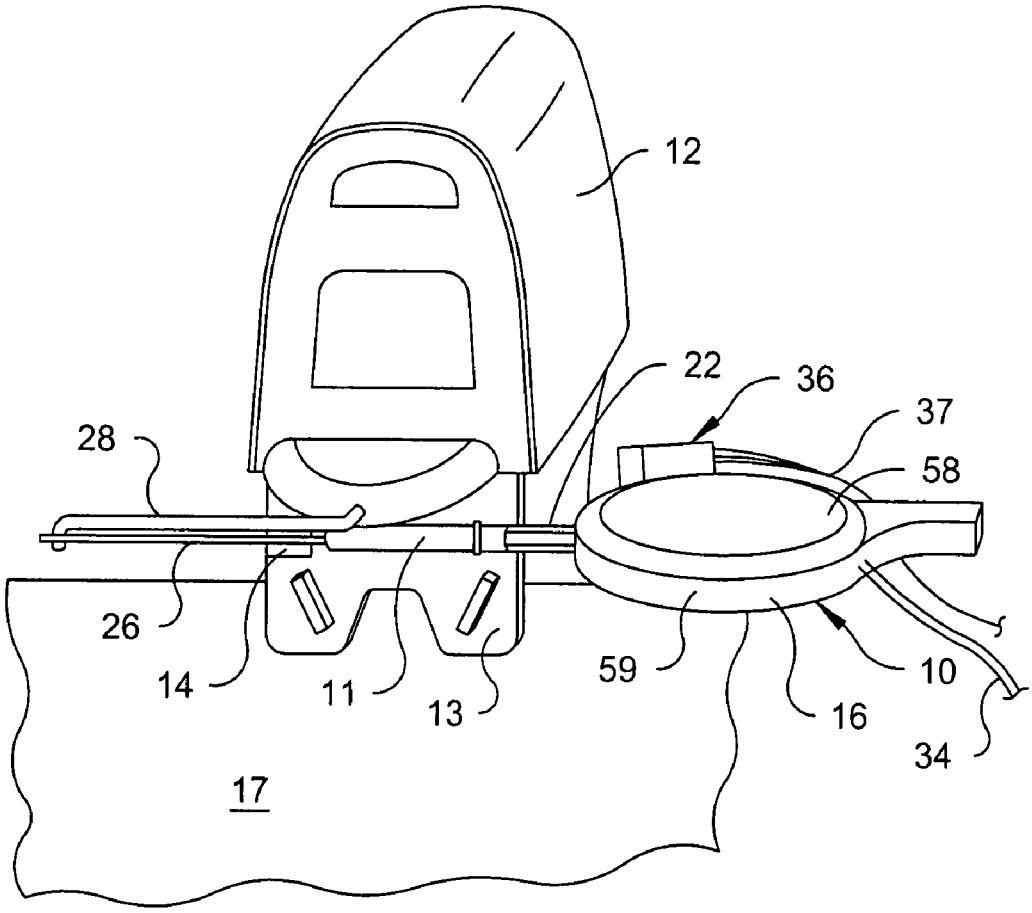
FIG. 1 is a front view in perspective of an outboard motor attached to a fragment of a boat, which outboard motor is in a use position and has attached to it a first embodiment of an electrically operated outboard motor steering assembly with a rudder reference sensor according to the invention.
Figure 2:
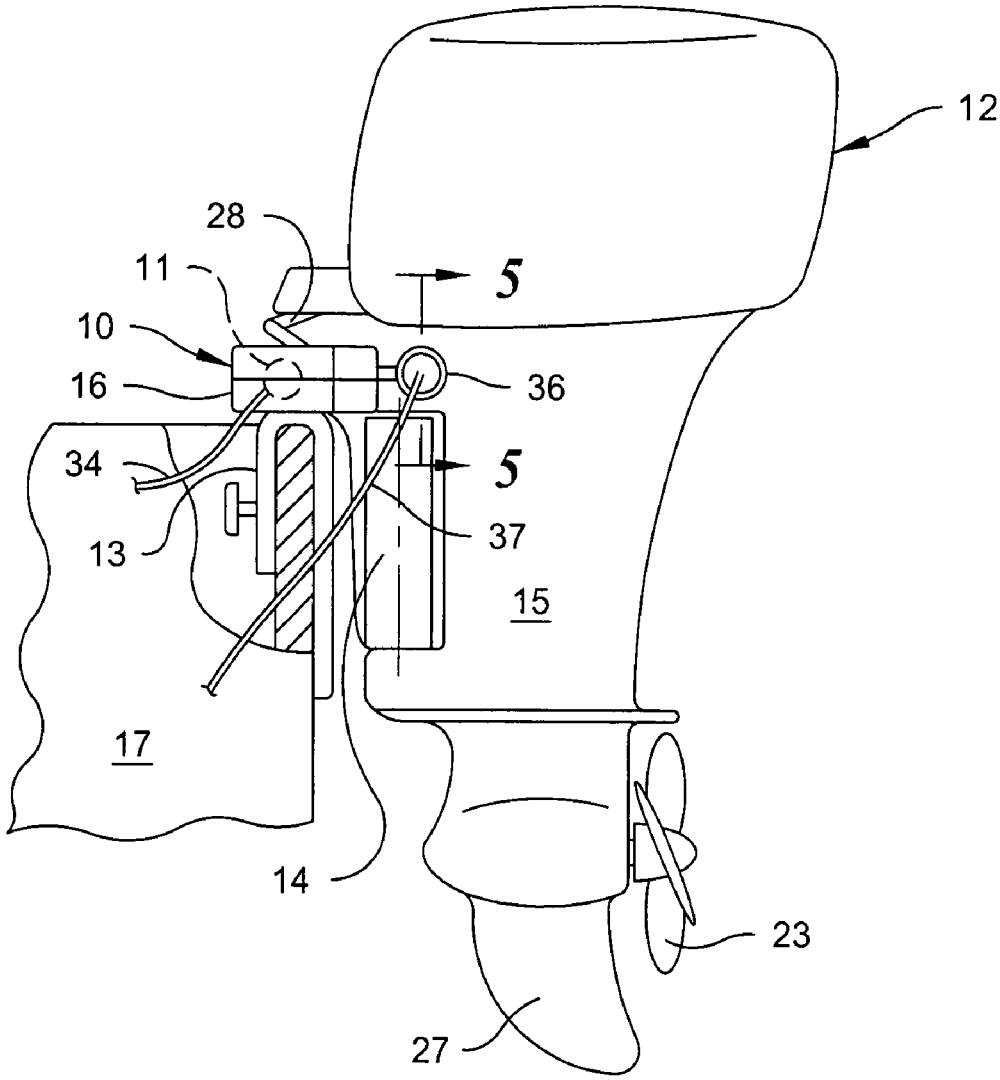
FIG. 2 is a right side view of the outboard motor, the boat transom, and the electrically operated outboard motor steering assembly show in FIG. 1.
Figure 3:
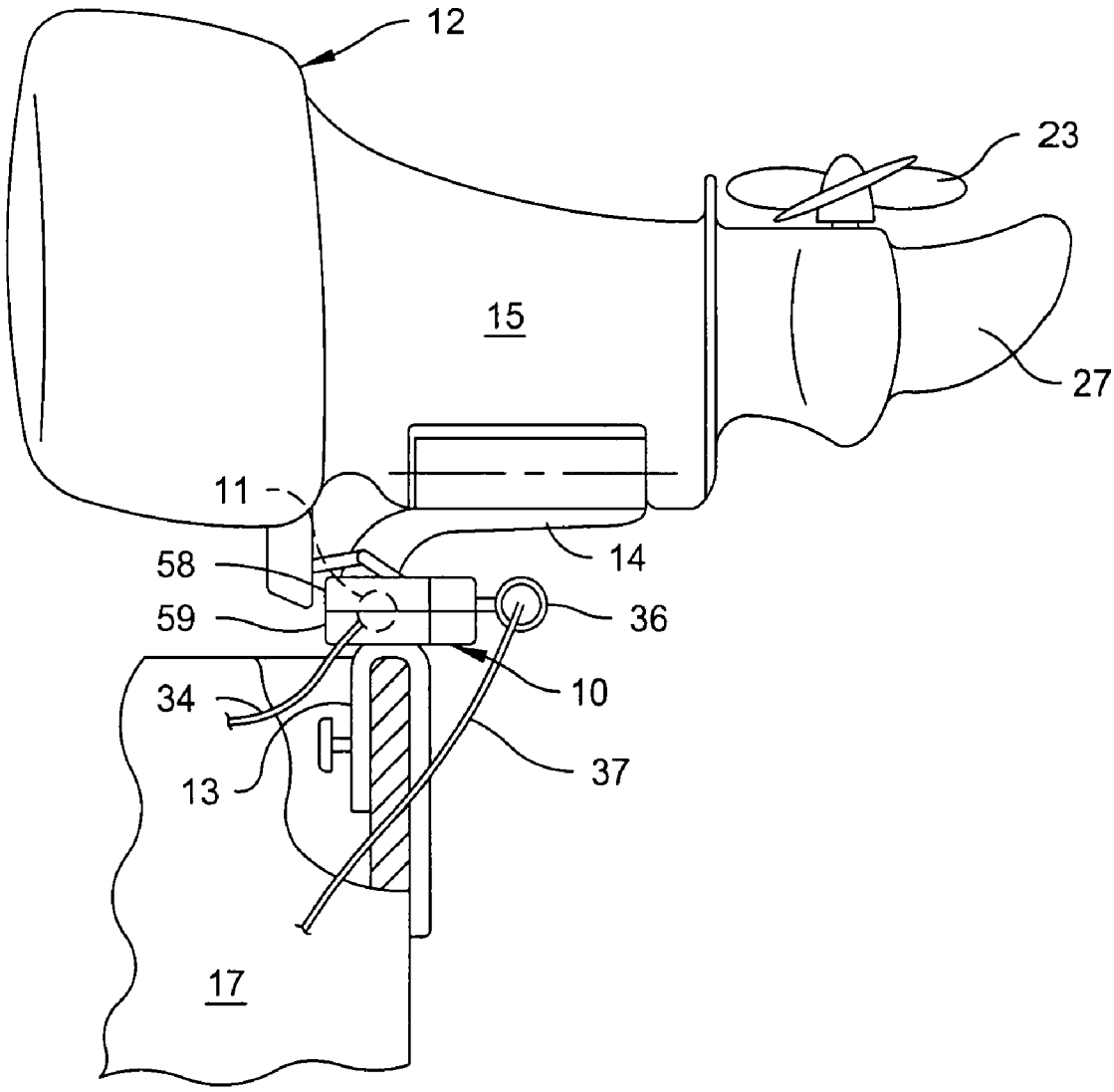
FIG. 3 is a right side view of the outboard motor, the boat transom, and the electrically operated outboard motor steering assembly shown in FIG. 1, in which view the outboard motor is shown in a storage portion.

The steering assembly, which is generally designated by the reference numeral 10. is adapted to engage with and operate a steering linkage through a cylindrical tube 11. The tube, which is included in many modern outboard motors, and illustrated in FIG. 1, is fixed relative to an attachment portion 13 of a mounting assembly included in the outboard motor 12, which attachment portion 13 is adapted to be attached (e.g., by clamps or bolts) in fixed relationship to the transom 17 at the stern of a boat.

The major portion of the outboard motor, which includes the engine, the rudder 27 and propeller 23 (FIG. 2), also includes a pivotable portion 14 aligned with the axis of tube 11. The major portion of the outboard motor is pivotable, about a pivot axis aligned with the central axis of tube 11, from a use position, in which the propeller and rudder are submerged, to a storage position, in which the propeller and rudder are out of the water.

A drive shaft housing 15 of the outboard motor assembly, which connects the engine housing to the rudder and propeller, is also part of the major portion of the outboard motor 12, and is pivotably mounted on the pivotal portion 14 of the mounting assembly for rotation about a steering axis disposed at a right angle with respect to the pivot axis that is aligned with the central axis of tube 11. Therefore, when the outboard motor is in its use position, with the rudder and propeller submerged, the boat is steered by rotation of the outboard motor assembly about the steering axis, which will be generally vertical.

The pivotal portion 14 of the mounting assembly, which carries the motor 12, the drive shaft housing 15, the propeller 23, and the rudder 27. is pivotably mounted on the attachment portion 13 so that, when the attachment portion 13 is attached to the transom 17 of a boat, a lower portion of the outboard motor 12 can be pivoted between the use position (FIGS. 1 and 2) with the rotation axis of the drive shaft generally vertical and the rudder 27 and propeller 23 submerged in the water; and a storage position (FIG. 3) with the rudder 27 and propeller 23 above the surface of the water where they will not interfere with operation of a primary drive system (not shown) on the boat.

Figure 4:
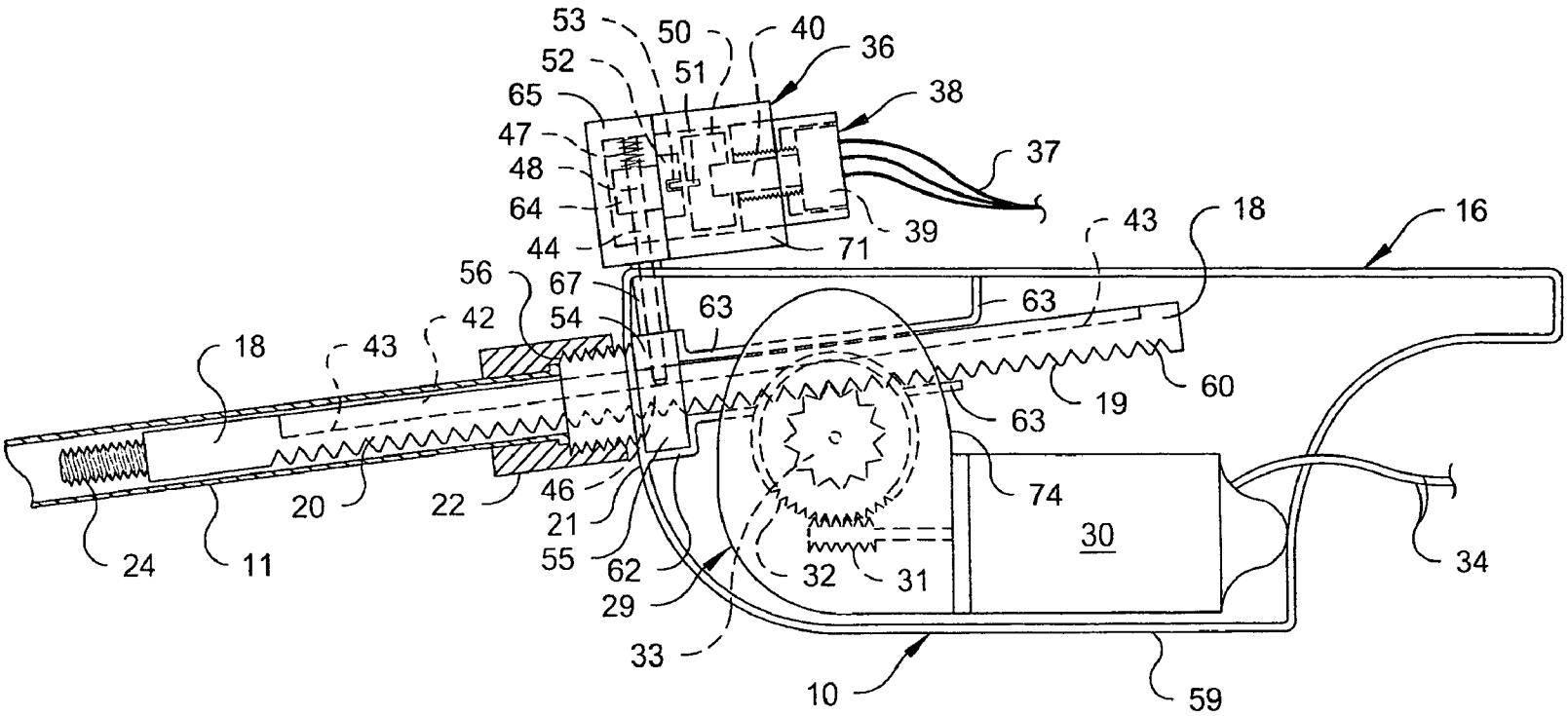
FIG. 4 is a top plan view of the outboard motor steering assembly shown in FIGS. 1, 2, and 3 that has been removed from the outboard motor, and from which a polymeric top cover of a housing included in the steering assembly has been removed to show details.
Figure 5:
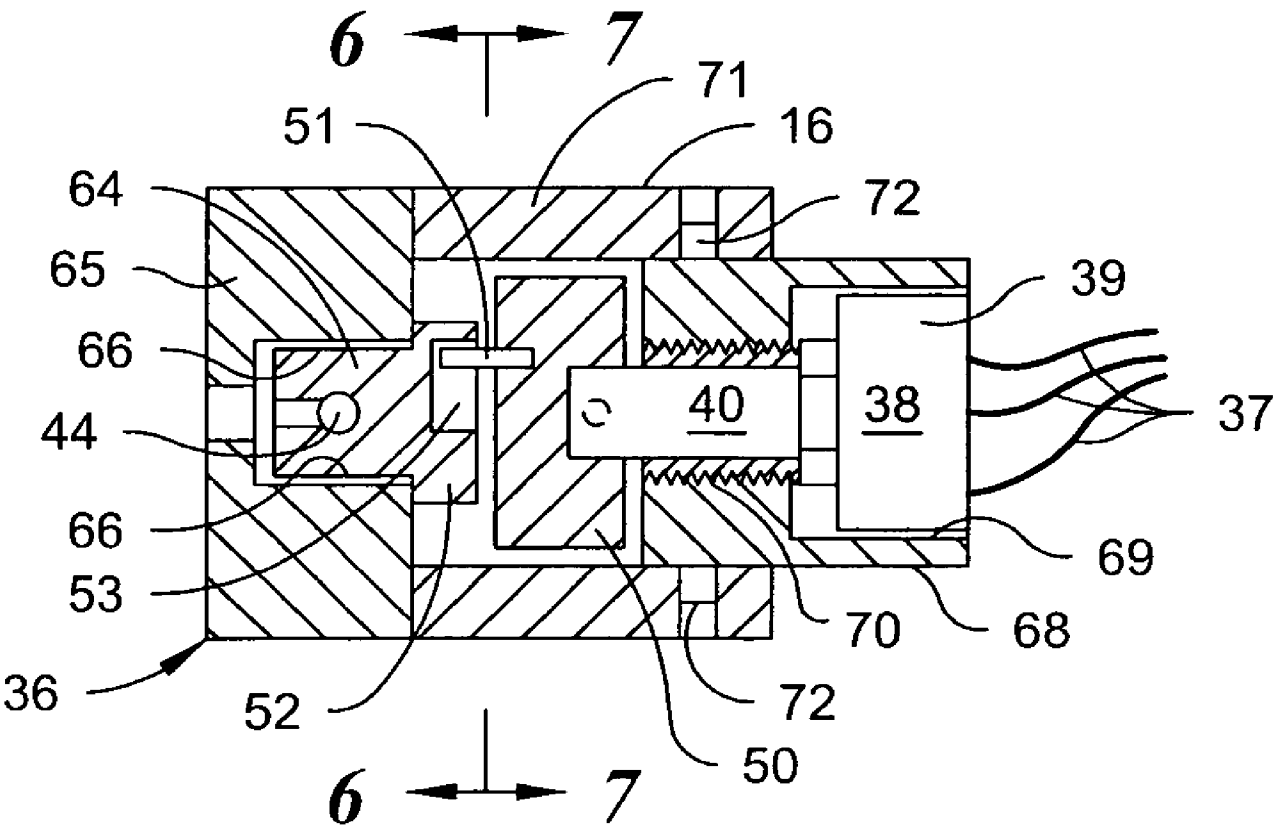
FIG. 5 is an enlarged sectional view taken approximately on section plane 5-5 in FIG. 2.
Figure 7:
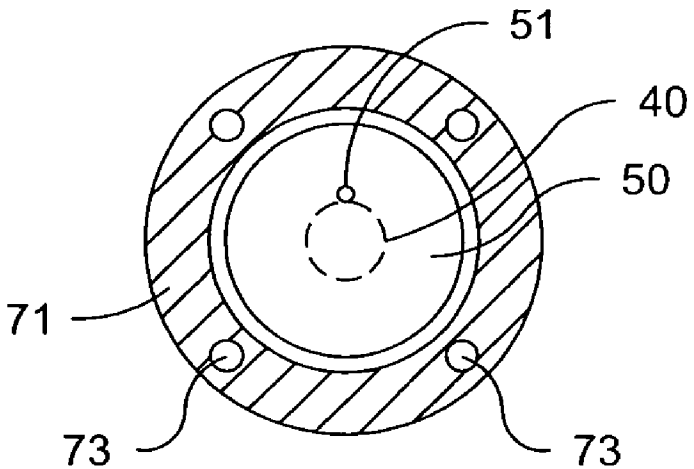
FIG. 7 is a sectional view taken on section plane 7-7 in FIG. 5.
Figure 6:
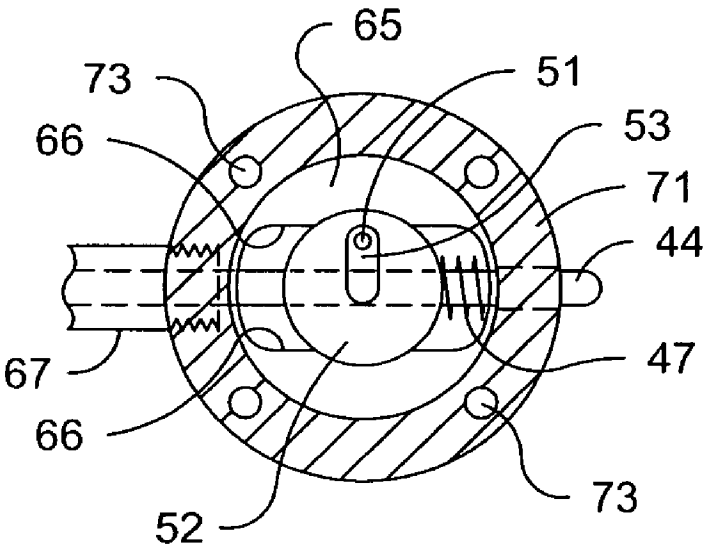
FIG. 6 is a sectional view taken on section plane 6-6 in FIG. 5.

As is best seen in FIG. 4, the steering assembly 10 comprises a housing 16, and an elongate rack 18 having a longitudinal axis and rack teeth 19 along the length of the rack 18 on one side of the rack. The rack is guided by suitable guide means provided in the housing 16 for longitudinal movement relative to the housing 16 between a retracted position and an extended position. A first end portion 20 of the rack 18 projects from a first end 21 of the housing assembly 16 and projects farther from the first end 21 of the housing 16 in its extended position than in its retracted position. Attachment means, including a nut 22, are provided for attaching the first end 21 of the housing 16 to one end of the tube 11 of the outboard motor 12, with the first end portion 20 of the rack 18 inside the tube 11 and the longitudinal axis of the rack 18 generally coincident with the pivot axis of the outboard motor 12.

An attachment means for connecting a steering linkage to the rack 18 comprises machine screw threads (e.g., 5/16-18 threads) provided at the distal end portion 24 of the rack 18, the threaded distal end portion having an axis parallel to the longitudinal axis of the rack 18. The threads are adapted for engagement, inside the outboard motor tube 11, with an internally threaded socket in an end portion of a cylindrical first part 26 of a two part steering linkage shown in FIG. 1. The steering linkage comprises two parts 26 and 28, and is connected between the distal end portion 24 of the rack 18 and a portion of the outboard motor 12 to cause rotary motion of the outboard motor and thereby the rudder 27 and the propeller 23, about a rotary axis which is substantially vertical when the outboard motor is in its use position. The cylindrical first part 26 of the two part steering linkage extends through, and projects from, a guide nut at the end of the tube 11 opposite the end of the tube to which the first end 21 of the housing 16 is attached. A second part 28 of the steering linkage is pivotably attached to the outboard motor 12.

The attachment means, which includes the externally threaded distal end portion 24 of the rack 18 allows the steering linkage to rotate relative to the rack 18 about an axis coincident with the pivot axis of the outboard motor 12 when the major portion of the outboard motor 12 is pivoted between its use and storage positions. Relative rotation between the steering linkage and the rack 18 can be provided for by threadably engaging the threaded distal end portion 24 of the rack 18 with the internally threaded socket in the first linkage part 26 without quite fully engaging them (i.e., at least a quarter turn from full engagement) so that the steering linkage can rotate relative to the rack 18 by rotation of internal threads around the socket around the external threads on the distal end portion 24 of the rack 18.

Referring again to FIG. 4, the steering assembly 10 includes rack drive means 29 including a reversible electric motor 30 coupled through worm gear 31, toothed wheel 32, and pinion 33 to the teeth 19 on the rack 18 for driving the rack 18 in either axial direction for incremental distances between its retracted and extended positions by electrically activating the motor 30 through two wires 34.

The rudder reference sensor or position indicator 36 included in the steering assembly 10 can provide a unique electrical signal through three wires 37 at any position of the rack 18 between its retracted and extended positions, and thereby at each position to which the rotatable portion of the outboard motor 12 is rotated about the steering axis by movement of the rack 18. The rudder reference sensor 36 includes a variable resistance potentiometer 38, to which the wires 37 are attached. The potentiometer 38 includes a fixed potentiometer portion 39, fixed to the housing 16, and a moveable potentiometer portion 40, mounted for movement relative to the fixed potentiometer portion 39. Each of the relative positions of the fixed and moveable portions of potentiometer 38 corresponds to a different pair of resistance values presented at the three wires 37.

Potentiometer adjustment means are provided between the rack 18 and the moveable potentiometer portion 40, for moving the movable potentiometer portion 40 to a different position with respect to the fixed potentiometer portion 39 for every position of the rack 18 between its retracted and extended positions. Thus, the potentiometer provides a different electrical signal for each position of the rack 18 between its retracted and extended positions.

The potentiometer adjustment means includes a longitudinally extending groove 42 formed in the rack and recessed from the side of the rack 18 opposite the rack teeth 19. The groove 42 is defined by surfaces including a planar innermost contact surface 43. Every portion of the contact surface 43 along the length of the groove 42 is at a different distance from a longitudinal axis of the rack. That is, the position of each portion of surface 43 with respect to the longitudinal axis of the rack 18 is different, the position being measured in a direction normal to the longitudinal axis of the rack 18. The potentiometer adjustment means also includes an elongate cylindrical follower 44 for longitudinal movement in a direction normal to the longitudinal axis of the rack 18. A first end 46 of the follower 44 contacts the contact surface 43 of the groove in the rack, and the follower is biased against the contact surface 43 by a spring 47 so that movement of the rack 18 between its retracted and extended positions will move the follower 44 longitudinally between a first, or inner, position and a second, or outer, position. Means are coupled between a second end portion 48 of the follower 44 opposite its first end 46 and the moveable variable resistance potentiometer portion 40 for moving the movable portion 40 to produce a different electrical resistance for each position of the second end portion 48 of the follower 44. The moveable variable resistance potentiometer portion 40 is preferably, but not necessarily, mounted on the fixed potentiometer portion 39 for rotation about an axis in a plane generally parallel to the longitudinal axis of the rack 18. The means coupled between the second end portion 48 of the follower 44 and the moveable potentiometer portion 40 comprises a rotor 50 fixed to the rotatable potentiometer portion and carrying a cylindrical pin 51 projecting from the rotor 50 at a position axially parallel to, and spaced (e.g., by about 0.125 inch or 0.3175 cm) from, the axis of rotation for the moveable potentiometer portion 40; and a rotor drive member 52 fixed to the second end portion 48 of the follower 44 and having a slot 53 receiving a distal portion of the pin 51 carried by the rotor 50, which slot 53 is defined by parallel surfaces disposed at a right angle to the longitudinal axis of the follower 44 and the direction of movement of the follower 44 between its first and second positions. The parallel surfaces defining the slot 53 closely receive the pin 51 therebetween so that contact between one of those surfaces and the pin 51 will rotate the rotor 50 and the movable potentiometer portion 40 through a small angle (i.e., less than 180 degrees) upon movement of the follower 44 between its first and second positions. The inner surface 43 of the groove 42 is positioned along the rack 18 so that the follower 44 is midway between its inner and outer positions when the rack 18 is midway between its retracted and extended positions. At this position, the rudder 27 and propeller 23 of the motor 12 are rotated to an "ahead" bearing, i.e., to a position at about a right angle with respect to the horizontal pivot axis of the motor 12. The rotor drive member 52 is attached along the follower 44 so that at those midway positions of the rack 18 and follower 44, the slot 53 in the rotor drive member 52 is aligned with the axis of the rotor 50, with the pin 51 at its maximum distance from the follower 44. Therefore, the rack 18, which has contact surface 43 in its groove, and the follower 44 which slides in the groove, constitute cooperating cam elements of a cam mechanism that rotates the moveable potentiometer portion 40 in response to movement of the elongated rack 18.

The housing 16 includes a plurality of parts fixed relative to one another, including a metal (e.g., aluminum) guide 54 including a generally rectangular first end portion 55, a second, opposite, generally cylindrical end portion 56 having threads about its periphery engaged with internal threads in an end portion of the nut 22, which portions 55 and 56 have a central through passageway with a rectangular cross section defined by surfaces closely receiving and guiding the outer surfaces of the rack 18. The parts of the housing 16 also include an upper, or first enclosure part 58 and a lower or second enclosure part 59, both preferably composed of a polymeric material such as the acetal copolymer known as CELCON M-90, available from Celanese Ticona, of 90 Morris Avenue, Summit, N.J. 7901. The polymeric enclosure parts 58 and 59 are attached together by screws, have peripheral walls engaging each other, and together define a central cavity in which are positioned the rack drive means 29, a second end portion 60 of the rack 18, and the rectangular first end portion 55 of the guide 54. The normally lower second enclosure part 59 includes inner locating walls 62, engaging and locating the periphery of the rectangular first end portion 55 of the guide 54, and includes guide walls 63, which help to locate and guide the rack 18. Further included with the housing 16 are parts included in the rudder reference sensor 36, including a circular part 65, having transverse parallel spaced surfaces 66 defining a transverse slot in which is positioned a projecting portion 64 of the rotor drive member 52 that is fixed by set screws to the second end portion 48 of the follower 44. Surfaces 66 guide the rotor drive member 52 for movement transverse of the circular part 65. A tubular part 67, has threaded end portions, one of which is in threaded engagement with the rectangular first end portion 55 of the guide 54, and other of which is in threaded engagement with the circular part 65. The tubular part 67 has a cylindrical inner surface closely receiving and guiding the cylindrical elongate follower 44. The spring 47, that biases the first end 46 of the follower 44 against the inner surface 43 of the groove 42 is disposed around the second end portion 48 of the follower 44, and is compressed between the projecting portion 64 of the rotor drive member 52 fixed to the second end portion 48 of the follower 44 and a surface of the circular part 65 at the end of the transverse slot in which that projecting portion 64 is positioned. The circular part 65 has a through opening, smaller than the transverse slot. The through opening is aligned with the circular part 65, and the second end portion 48 of the follower 44 can project through the through opening when it is moved to its second or outer position. The housing 16 also includes a cylindrical part 71 to which the circular part 65 is attached by screws through openings 73. The cylindrical part 71 has a cylindrical center opening in which are located the rotor 50 and the rotor drive member 52. Also included with the housing 16 is a housing 68 in which the potentiometer 38 is positioned.

The potentiometer 38 is preferably a 5 K ohm precision variable rotary resistor such as that made by Vishay Spectrol of Malvern, Pa., part No. 375-0-0-1 P22-502, and sold under the trade designation "Part No. 95B9046 by Newark InOne, Chicago, Ill. The resistors within the potentiometer 38 are attached to three wires 37, which include a central wire and second and third wires on opposite sides of the central wire. At a central position of the rotary moveable portion 40 of the potentiometer 38 with respect to the fixed portion 39 of the potentiometer 38, the potentiometer 38 provides the same resistance, about 2.5 K ohms, between the central wire and each of the second and third wires. When the rotary moveable portion 40 of the potentiometer 38 moves with respect to the fixed potentiometer portion 39 in either direction from that central position, the resistance between the central wire and the second or third wire toward which the moveable portion 40 moves increases linearly toward a maximum of about 3.2 k, whereas the resistance between the central wire and the other of the first and second wires decreases linearly toward a minimum of about 1.8 k. Those resistances indicate to the computer operated guidance system, to which the wires 37 are attached, the direction of the rudder 27 and the propeller 23 of the outboard motor 12.

The potentiometer housing 68 has a cylindrical periphery, and a through passageway. The through passageway includes a cylindrical recess 69, in which a cylindrical part of the fixed potentiometer portion 39 is located, /and a smaller diameter, internally threaded, portion 70 in which a threaded part of the fixed potentiometer portion 39 is engaged to fix the fixed portion 39 of the potentiometer 38 on the housing 16. Projecting through the threaded part of the fixed potentiometer portion 38 is a cylindrical part of the rotatable moveable portion 40 of the potentiometer 38 on which the rotor 50 is fixed by set screws. A portion of the cylindrical periphery of the potentiometer housing 68 is received and fixed by set screws 72 in a cylindrical inner surface of the cylindrical part 71. By releasing the set screws 72 the potentiometer housing 68 can be rotated within the cylindrical part 71 and then again fixed by the set screws 72 in a desired position at which, with the rack 18 positioning the outboard motor 12 so that it propels the boat 14 in a direction generally parallel to the centerline of the boat 14, the parts of the potentiometer 38 are at a relative position that provides a balanced resistance, from which position the resistance between the central wire and one of the first and second wires of wires 37 will increase if the rudder 27 and propeller 23 of the outboard motor 12 are rotated in a first direction, and decrease if the rudder and propeller are rotated in the opposite direction. The resistance between the central wire and the other of the first and second wires will change in the opposite way. The housing 16 should also include a polymeric housing (not shown) around the circular part 65, cylindrical part 71 and potentiometer housing 68 to restrict water from entering and particularly to keep the potentiometer 38 dry.

The reversible direct current electric motor 30 coupled through gears 31, 32, and 33 to the teeth 19 on the rack 18 for driving the rack 18 in either axial direction can be the 12 volt motor commercially available from Robert Bosch GmbH, Stuttgart, Germany, under the trade designation "CBMA0010 LH High Torque Window Motor. The worm gear 31 is carried by an output shaft on the motor 30 and is a four thread per inch or 1.5 thread per centimeter worm gear engaged with the periphery of the large intermediate one inch or 2.5 centimeter diameter toothed wheel 32, rotatably mounted on a housing 74 on which the motor 30 is supported. The housing 74 is attached by screws (not shown) to the second or lower polymeric enclosure part 59 of the housing 16. One side of the toothed wheel 32 is coaxially fixed to the pinion 33 that is engaged with rack teeth 19.

The steering assembly 10 includes an electrically operated steering device commercially available from Marine Tech Products, Inc., White Bear Lake, Minn. under the trade designation "T4, Through the Tilt Tube Electro Steer" which has been modified by addition of the rudder reference sensor 36 described above. The non-modified "T4" electrically operated steering device includes the rack drive means 29, including the motor 30 and gearing 31, 32, and 33; the first and second polymeric enclosure portions 58 and 59; the guide 54; the nut 22; and a rack that is similar to the rack 18 except that it does not include the groove 42 with the planar contact surface 43.

The steering assembly 10 can provide resistance signals through the wires 37 to indicate the position of the rudder and propeller of the outboard motor 12 to a computer operated guidance system G of the type described above. When a course correction is needed, the guidance system will calculate the correction and operate the rack drive 29 through wires 34 as needed to correct the course for the boat.

Figure 11:
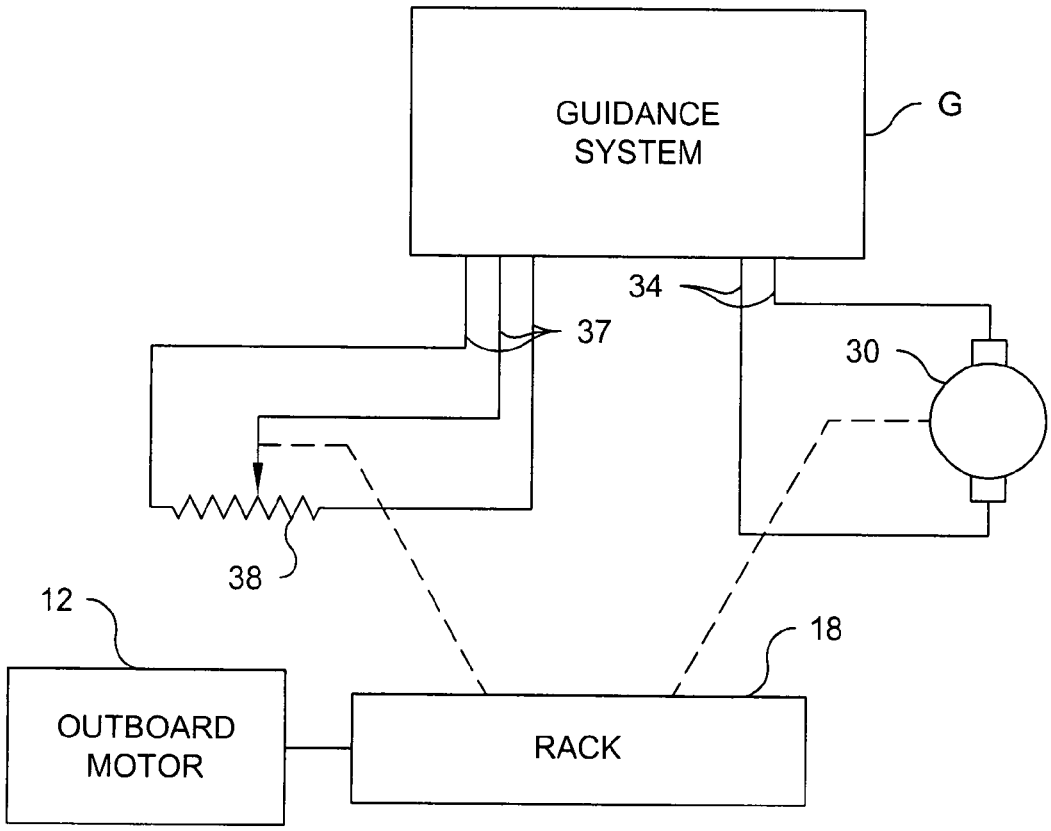
FIG. 11 is a schematic diagram showing the relationship of the position sensor and steering motor to the outboard motor and to a computer-controlled guidance system.

FIG. 11 shows the guidance system G, connected to potentiometer 38 by wires 37 and connected to drive the electric motor 30 through wires 34. The rack 18 is shown connected in driven relationship to the electric motor 30, and in driving relationship with outboard motor 12 and potentiometer 38.

The steering assembly 10 is particularly useful when the motor is a small horsepower outboard motor (e.g., 5 to 15 h.p.) of the type used to propel fishing boats at slow speeds (e.g., 1 to 3 m.p.h.) while trolling for fish. Such a motor may include a remotely controlled electric-hydraulic system (not shown) of a known type that can move the motor between its use and storage positions, and can include a conventional, remotely controlled, electric starting system and a remote speed control so that, under normal circumstances, there is no need for any manual contact with the motor during its operation. This can be very convenient, particularly when structure at the stern of the boat (e.g., a row of fishing rods in sockets) limits access to the outboard motor.

Figure 8:
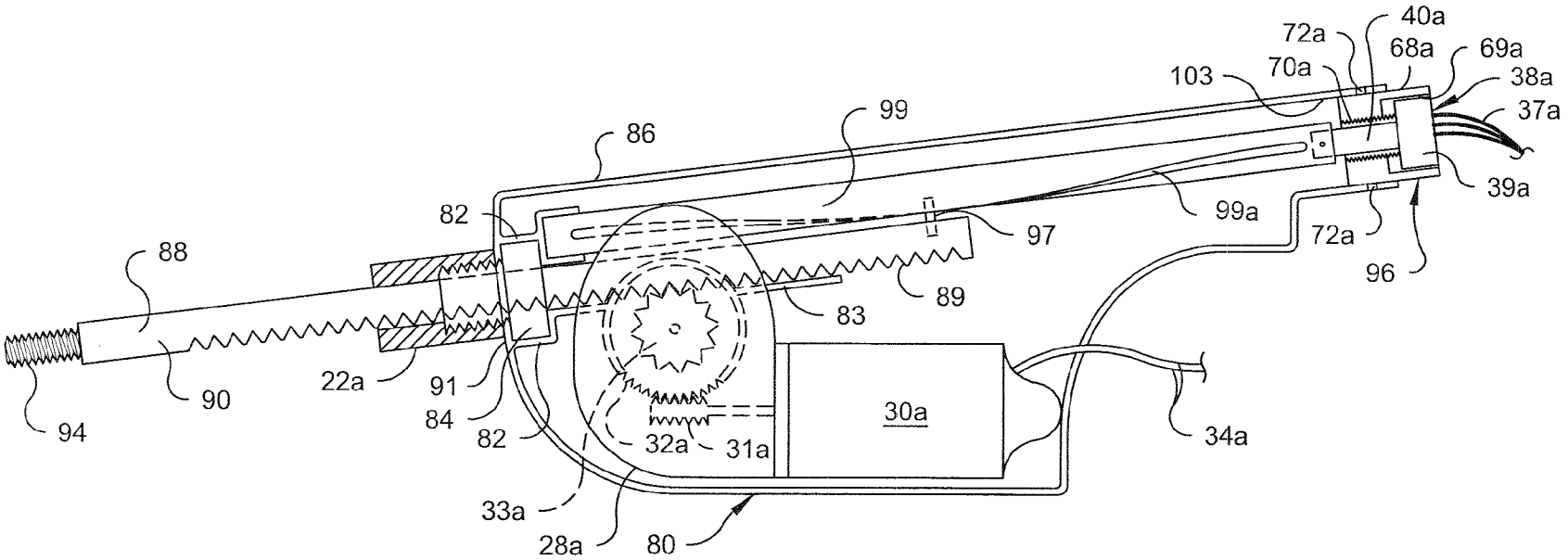
FIG. 8 is a top plan view, partly in section, showing a second embodiment of the outboard motor steering assembly with a rudder reference sensor according to the invention, from which a polymeric top cover of a housing assembly has been removed to show details.

FIG. 8 illustrates a second embodiment of an outboard motor steering assembly, generally designated by the reference numeral 80, with a rudder reference sensor according to the invention. Parts of the steering assembly 80 and other structures that are the same as parts of the steering assembly 10 and other structures described above have been identified by the same reference numerals to which have been added the suffix "a". Like the steering assembly 10, the steering assembly 80 is adapted to engage and operate through a cylindrical tube on an outboard motor such as the tube 11 of the outboard motor 12 illustrated in FIG. 1.

The steering assembly 80 comprises a housing 86, and an actuator element in the form of an elongate rack 88, having a longitudinal axis and rack teeth 89 spaced along the length of the rack 88 on one side of the rack 88. Means including a guide 84, shaped like the guide 54 described above (except that it has no opening for a follower 44 or a tubular part 67, which are not used in the steering assembly 80) and walls 82 and 83 of a polymeric enclosure portion of the housing 86 are provided for mounting the rack 88 on the housing 86 for longitudinal movement relative to the housing 86 between a retracted position and an extended position with a first end portion 90 of the rack 88 projecting from a first end 91 of the housing 86 and projecting farther from the first end 91 of the housing 86 in its extended position than in its retracted position. Attachment means, including a nut 22*a* having an end portion threadably engaged with a threaded end portion of the guide 84, are provided for attaching the first end 91 of the housing 86 to one end of the tube of the outboard motor with the first end portion 90 of the rack 88 inside the tube and the longitudinal axis of the rack 88 generally coincident with the pivot axis of the outboard motor. Attachment means comprising a distal end portion 94 of the rack 88, having machine screw threads around an axis parallel to the longitudinal axis of the rack 88, are adapted for engagement inside the tube of the outboard motor, with an internally threaded socket in an end portion of a cylindrical first part of a two part steering linkage, like the two part linkage described above, between the first end portion 90 of the rack 88, and a rotating portion of the outboard motor, to cause rotary motion of the rudder and propeller of the outboard motor about a rotary axis normal to a plane in which the pivot axis of the outboard motor lies. The attachment means allows the parts of steering linkage to rotate relative to the rack 88 about an axis coincident with the pivot axis of the outboard motor when the major portion of the outboard motor is pivoted between its use and storage positions in the same manner described above for the steering assembly 10. The steering assembly 80 includes rack drive means 28*a* which is the same as the rack drive means 28 described above including a reversible electric motor 30*a* coupled through gearing 31*a*, 32*a*, and 33*a* to the teeth 89 on the rack 88 for driving the rack 88 in either axial direction by electrically activating the motor 30*a* through two wires 34*a*. The steering assembly 80 also includes a rudder reference sensor or position indicator 96, that can provide a unique electrical signal at any position of the rack 88 between its retracted and extended positions, and thereby at each position to which the rudder and propeller of the outboard motor is rotated about its rotary axis by movement of the rack 88. The rudder reference sensor 96 includes a variable resistance potentiometer 38*a* including a fixed potentiometer portion 39*a* fixed to the housing 86 and a moveable potentiometer portion 40*a* mounted for movement on the fixed potentiometer portion 39*a* between various relative positions, with the potentiometer 38*a* providing a different resistance at each of those relative positions; and potentiometer adjustment means between the rack 88 and the moveable potentiometer portion 40*a* for moving the movable potentiometer portion 40*a* to a different position with respect to the fixed potentiometer portion 39*a* for every position of the rack 88 between its retracted and extended positions to produce a different electrical resistance through the potentiometer 39*a* and wires 37*a* for every position of the rack 88 between its retracted and extended positions. In the outboard motor steering assembly 80, the potentiometer adjustment means between the rack 88 and the moveable potentiometer portion 40*a* is provided by the rack 88 carrying a pin 97, having one end fixed to the rack 88 and projecting transversely, preferably at a right angle, with respect to the longitudinal axis of the rack 88. The moveable variable resistance potentiometer portion 40*a* is mounted on the fixed potentiometer portion 39*a* for rotation about an axis generally parallel to the longitudinal axis of the rack 88, and the outboard motor steering assembly 80 includes an elongate generally cylindrical member 99, mounted on the housing 86 for rotation about an axis coaxial with the axis of rotation for the moveable variable resistance potentiometer portion 40*a*. A distal end of the rotatable variable resistance potentiometer portion 40*a* is coaxially received in a socket in one end of the generally cylindrical member 99 and is fixed in that socket by set screws; and the generally cylindrical member 99 has opposed radially extending surfaces defining a helical groove 99*a*, extending about 180 degrees about its periphery and closely receiving a distal end portion of the pin 97 carried by the rack 88 so that, through contact between the pin 97 fixed to the rack 88 and the opposed surfaces defining the helical groove 99*a*, movement of the rack 88 between its retracted and extended positions will rotate the cylindrical member 99 through a small angle (e.g., less than 180 degrees), and thereby rotate the movable potentiometer portion 40*a* through that angle. The cylindrical member 99 and the pin 97 thus serve as cooperating cam elements of a cam mechanism that rotates the moveable potentiometer portion 40*a*in response to movement of the elongate rack 88.

The fixed portion 39*a* of the potentiometer 38*a* is mounted on the housing 86 by a potentiometer housing 68*a* included in the housing 86. The potentiometer housing 68*a* has a cylindrical periphery, and a through passageway including a cylindrical recess 69*a* in which a cylindrical part of the fixed potentiometer portion 39*a* is located, and a smaller diameter internally threaded portion 70*a* in which a threaded part of the fixed potentiometer portion 39*a* is engaged to fix the fixed portion 39*a* of the potentiometer 38*a* on the housing 86. Projecting through that threaded part of the fixed potentiometer portion 39*a* is a cylindrical part of the rotatable moveable portion 40*a* of the potentiometer 38*a* that is fixed co-axially in the socket in the end of the cylindrical member 99 by set screws. A portion of the cylindrical periphery of the potentiometer housing 68*a* is received and fixed by set screws 72*a* in a cylindrical inner surface 103 of the polymeric housing 86. By releasing the set screws 72*a*, the potentiometer housing 68 can be rotated within the cylindrical inner surface 103 of the housing 86 and then again fixed by the set screws 72 in a desired position at which, with the rack 88 positioning the outboard motor so that it propels the boat in a direction generally parallel to the centerline of the boat, the parts of the potentiometer 38*a* are at a relative position that provides the same resistance through both pairs of the wires 37*a*, from which position the resistance in one pair of wires 37*a* will increase, and the resistance in the other pair of wires will decrease if the rudder and propeller of the outboard motor are rotated in either direction.

The housing 86 should include a polymeric housing (not shown) around the potentiometer housing 68*a* to restrict water from entering and particularly to keep the potentiometer 38*a* dry.

The steering assembly 80 can provide resistance signals through the wires 37*a* to indicate the position of the rudder and propeller of the outboard motor to a computer operated guidance system (not shown) of the type described above, which guidance will operate the rack drive means 28*a* through the wires 34*a* as needed to correct the course for the boat.

Figure 9:
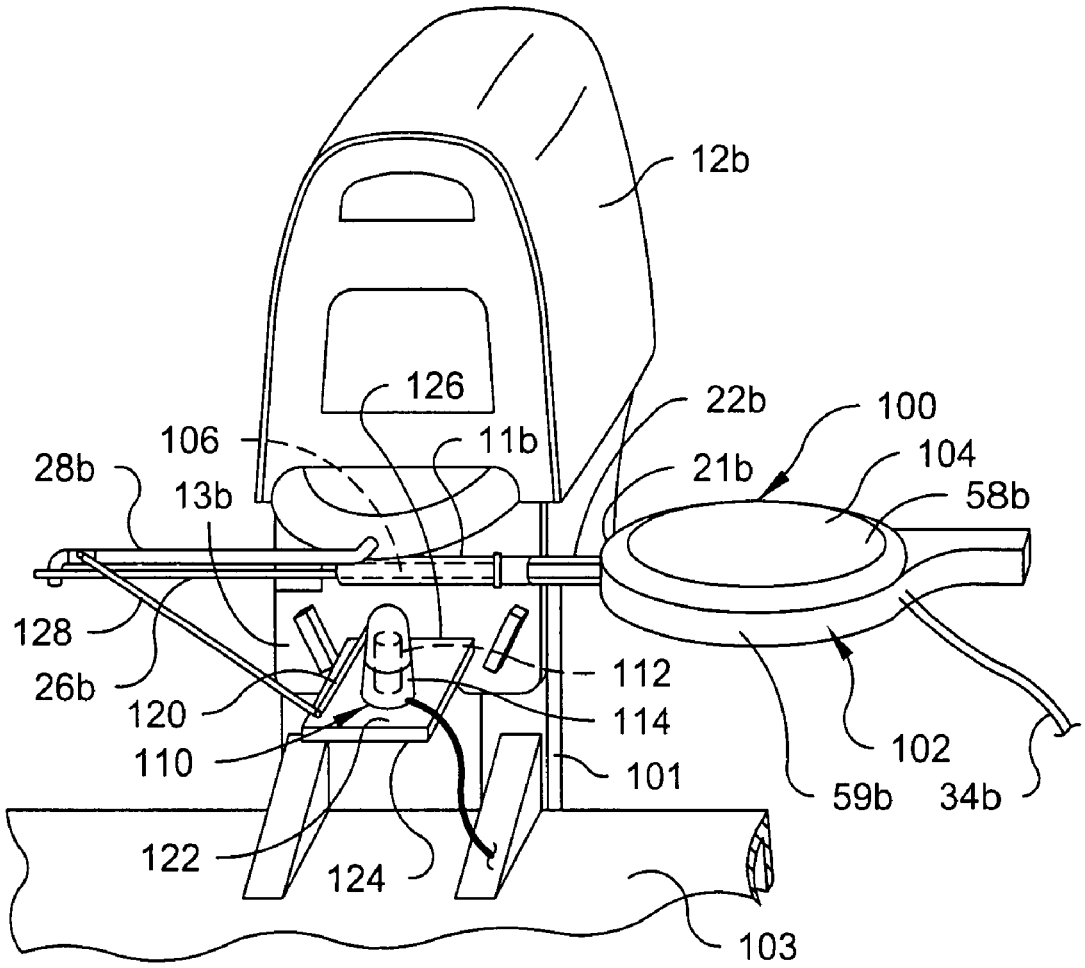
FIG. 9 is a front view in perspective of an outboard motor attached to a bracket on the transom of a boat, which outboard motor is shown in a use position and to which outboard motor is attached a third embodiment of an electrically operated outboard motor steering assembly with a rudder reference sensor according to the invention.
Figure 10:
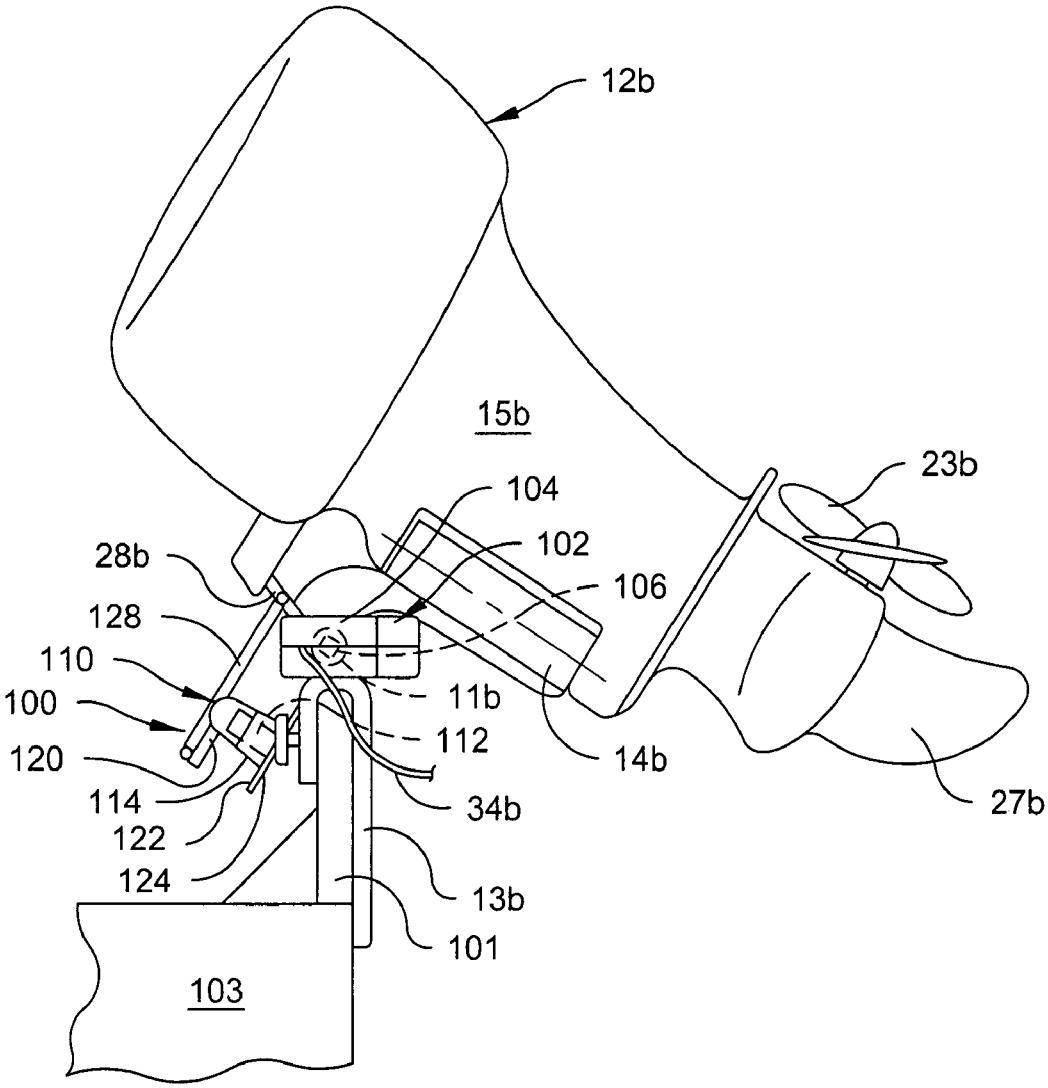
FIG. 10 is a right side view of the outboard motor, the boat transom, and the electrically operated steering assembly of the third embodiment of the electrically operated outboard motor steering assembly shown in FIG. 9, in which the outboard motor is shown in a storage position.

FIGS. 9 and 10 of the drawing illustrate a third embodiment, generally designated by the reference numeral 100, of an outboard motor steering assembly according to the invention. In FIGS. 9 and 10 parts of the steering assembly 100, or other structures that are the same as parts of the steering assembly 10 and other structures described above, have been identified by the same reference numerals to which have been added the suffix "b".

Like the outboard motor steering assemblies 10 and 80, the outboard motor steering assembly 100 is adapted to operate through a cylindrical tube 11*b* on an outboard motor 12*b*, which tube 11*b* is fixed relative to an attachment portion 13*b* of a mounting assembly included in the outboard motor 12*b* that is attached (e.g., by clamps or bolts) in fixed relationship on a bracket 101 attached to the transom 103 of a boat, and about which tube 11*b* one end of a pivotal portion 14*b* of the mounting assembly for the outboard motor 12*b* is pivotably mounted so that a major portion of the outboard motor 12*b*, including its rudder 27*b* and propeller 23*b*, can be pivoted about 30 degrees or more between a use position (FIG. 9) with the rudder 27*b* and propeller 23*b* under water, and a storage position (FIG. 10) with the rudder 27*b* and propeller 23*b* above the surface of the water.

The steering assembly 100 includes an electrically operated steering device 102 such as the Marine Tech Products, Inc., "T4, Through the Tilt Tube Electro Steer" steering device. The "T4" steering device Includes structure most of which is not shown in FIGS. 9 and 10, but is the same as the structure described above with respect to the steering assembly 10 including (with reference to FIGS. 1 through 4) the rack drive means 29 comprising the motor 30 and gearing 31, 32, and 33; the first and second polymeric enclosure portions 58*b* and 59*b*; the guide 54; the nut 22*b*; and a rack 106 that is similar to the rack 18 in that it has rack teeth 19 along its length, and a threaded distal end portion 24, but is dissimilar in that it does not include the groove 42 with the planar innermost contact surface 43. The steering device 102 includes a housing 104; rack mounting means for mounting the rack 106 on the housing 104 for longitudinal movement relative to the housing 104 between a retracted position and an extended position with a first end portion of the rack 106 projecting from a first end 21*b* of the housing 104 and projecting farther from the first end 21*b* of the housing 104 in its extended position than in its retracted position; housing attachment means including a nut 22*b* for attaching the first end 21*b* of the housing 104 to one end of the tube 11*b* of the outboard motor 12*b* with the first end portion of the rack 106 in the tube 11*b* of the outboard motor 12*b* and the longitudinal axis of the rack 106 generally coextensive with the pivot axis of the outboard motor 12; rack to linkage attachment means comprising a distal end portion of the rack 106 having machine screw threads around an axis parallel to the longitudinal axis of the rack 106 and adapted for engagement, within the tube 11*b* of the outboard motor 12*b*, with an internally threaded socket in an end portion of a cylindrical first part 26*b* of a two-part steering linkage between the first end portion of the rack 106 and a rotary portion of the outboard motor 12*b* to cause rotary motion of the outboard motor 12*b*, and thereby the rudder 27*b* and propeller 23*b* of the motor 12*b* about a rotary axis normal to a plane in which the pivot axis of the outboard motor lies. The rack to linkage attachment means allows that steering linkage to rotate relative to the rack 106 about an axis coincident with the pivot axis of the outboard motor 12*b* in the same manner described above for the steering assembly 10 when the major portion of the outboard motor 12*b* including the rudder 27*b* and the propeller 23*b* is pivoted between its use and storage positions. The rack drive means 29 includes the reversible electric motor 30, coupled through the gearing 31, 32, and 33 to the rack teeth 19 on the rack 106, for driving the rack 106 in either axial direction for incremental distances between its retracted and extended positions by electrically activating the motor 30 through wires 34*b*. Except as noted above, those rack mounting means, housing attachment means, rack to linkage attachment means and rack drive means are essentially the same as the corresponding means described above with reference to the outboard motor steering assembly 10 described above.

The steering assembly 100 also includes a rudder reference sensor 110, that can provide a unique electrical signal at any position of the rack 106 between its retracted and extended positions, and thereby at each position to which the rotatable portion of the outboard motor 12*b* is rotated about its rotary axis by movement of the rack 106. The rudder reference sensor 110 is preferably the same as, or similar to, the rudder reference sensor commercially available Raymarine E15022 "Rotary Rudder Reference Bracket", model 5915368, commercially available from West Marine, Watsonville, Calif. The rudder reference sensor 110 includes a variable resistance potentiometer 112 (e.g., the example potentiometer identified above) including a fixed potentiometer portion fixed in a base 114 for the rudder reference sensor 110, and a moveable potentiometer portion mounted for rotary movement on the fixed potentiometer portion between various relative positions with the potentiometer 112 providing a different resistance at each of those relative positions. Rotary movement is about an axis disposed at a right angle with respect to a bottom surface of the base 114. One end of a sensor arm 120 is attached to the moveable potentiometer portion and projects at a right angle to the axis of rotation of the moveable potion of the potentiometer 112. The bottom surface on the base 114 of the rudder reference sensor 110 is mounted on a planar support surface 122 of a rigid plate 124 included in the steering assembly 100. The plate 124 has one end portion 126 fixed to the pivotal portion 14*b* of the mounting assembly of the outboard motor 12*b*, and projects from and below the side of the tube 11*b* opposite the rotatable portion 15*b* of the mounting assembly for the outboard motor 12*b* so that the plate 124 moves with the pivotal portion 14*b* when the major portion of the outboard motor 12*b*, including its rudder 27*b* and propeller 23*b*, moves between its use and storage positions. The planar support surface 122 is disposed generally parallel to the pivot axis of the pivotal portion 14*b* of the mounting assembly for the outboard motor 12*b* and is disposed at about a right angle with respect to the axis of rotation for the rotatable portion 15*b* of the mounting assembly for the outboard motor 12*b*. The rudder reference sensor 110 is mounted on the support surface 122 of the plate 124 with the axis of rotation of the moveable potentiometer portion on the side of the pivot axis of the pivotal portion 14*b* opposite the axis of rotation for the rotatable portion 15*b*, and spaced from the pivot axis of the pivotal portion 14*b* and with the arm 120 projecting away from the pivot axis of the pivotal portion 14*b*.

Potentiometer adjustment means are provided between the rack 106 and the moveable potentiometer portion 112 for moving the movable potentiometer portion to a different position with respect to the fixed potentiometer portion for every position of the rack 106 between its retracted and extended positions to produce a different electrical resistance through the potentiometer 112 for every position of the rack 106 between its retracted and extended positions and thereby for every position to which the rotatable portion 15*b* of the mounting assembly for the outboard motor 12*b* and thereby the rudder 27*b* and propeller 23*b* can be rotated. That potentiometer adjustment means includes an adjustable length arm 128 pivotably mounted between a second distal end of the sensor arm 120 opposite its first end attached to the moveable potentiometer portion and the second part 28*b* of the linkage close to its pivot juncture with the first part 26*b* of the two part linkage between the rack 106 and the rotatable portion 15*b* of the mounting assembly for the outboard motor 12*b*. Thus, like that two part linkage, the plate 124, the rudder reference sensor 110, and the adjustable length arm 128 between the sensor arm 120 and that two part linkage move without changing the relationships therebetween when the major portion of the outboard motor 12*b* including the pivotal portion 14*b*, the rudder 27*b* and the propeller 23*b* moves between its use and storage positions.

The adjustable length arm 128 includes a length of threaded rod to both ends of which are threadably engaged polymeric sockets adapted to resiliently engage over metal pivot balls, one of which pivot balls is supported on an end of the sensor arm 120 and the other of which pivot balls is supported on a bracket clamped to the second part 28*b* of the linkage. By removing one of the sockets from the ball with which it is engaged, releasing a lock nut between the rod and the socket and rotating the socket relative to the threaded rod the adjustable length arm 128 can be adjusted to a length at which, with the rack 106 positioning the outboard motor 12*b* so that it propels the boat 103 in a direction generally parallel to the centerline of the boat 103, the portions of the potentiometer 112 are at a relative position that provides equal resistances in both pairs of wires connected to the potentiometer. Thus, the resistance in one pair of wires will increase, and the resistance in the other pair of wires will decrease if the outboard motor 12*b* is rotated in either direction.

O ring seals (not shown) may be needed between the base 114 and sensor arm 120 of the rudder reference sensor 110 and potting compound may be needed around the potentiometer 112 to restrict entry of water in order to keep the potentiometer 112 dry.

The mounting bracket 101 may or may not be needed on a boat to support the attachment portion 13*b* of the mounting assembly for the outboard motor 12*b* in a position and way that provides a space into which the plate 124, the rudder reference sensor 110, and the adjustable arm 128 can move when the major portion of the outboard motor 12*b* is moved to its storage position.

The steering assembly 100 can provide resistance signals through the wires 37*b* to indicate the position of the rudder and propeller of the outboard motor 12*b* to a computer operated guidance system (not shown) of the type described above, which guidance system, when a course correction is needed, will operate the rack drive means 29*b* through the wires 34*b* to correct the course for the boat.

Figure 12:
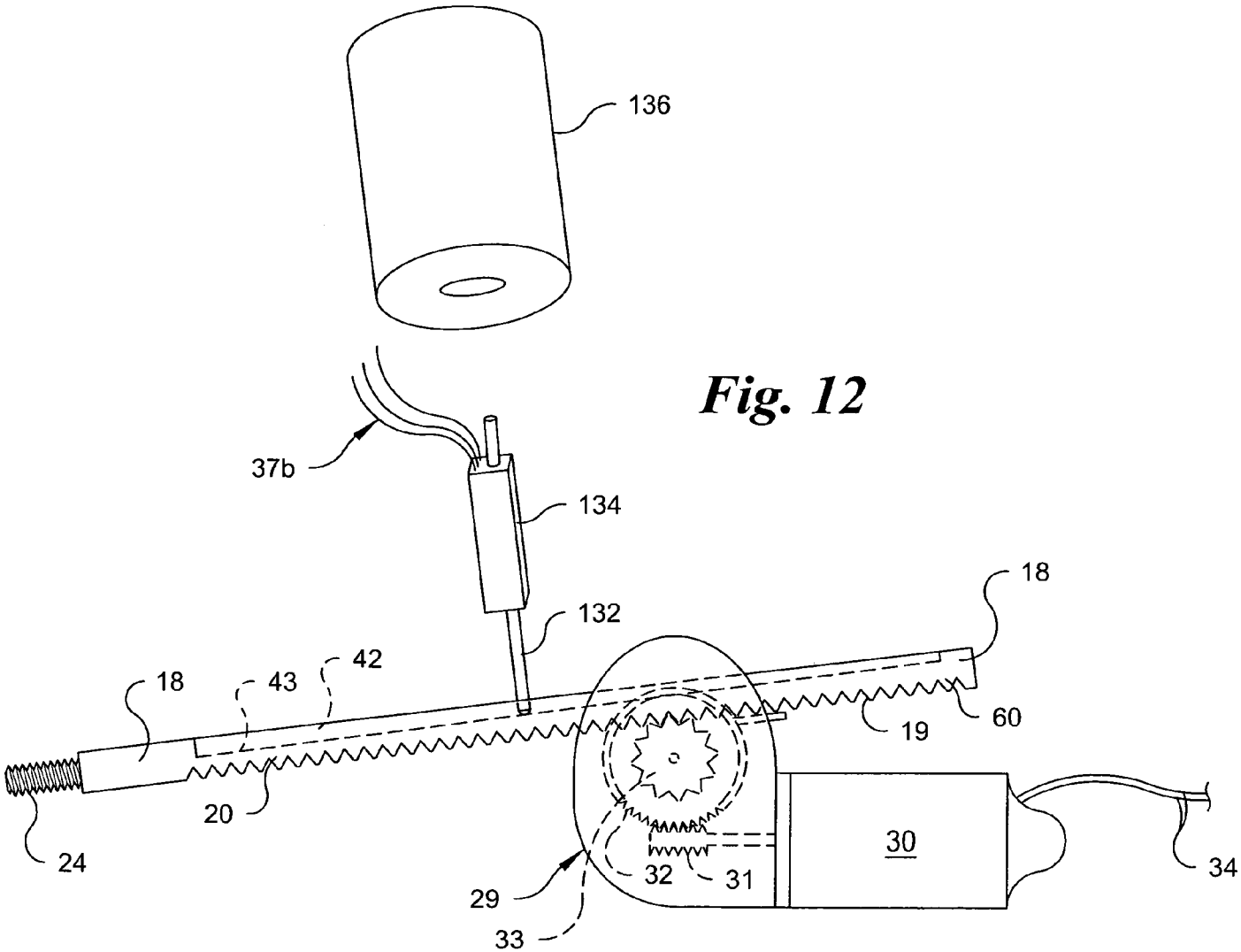
FIG. 12 is an exploded schematic view of an alternative version of the steering assembly, in which the position sensor incorporates a linear potentiometer.

In the modification illustrated in FIG. 12, the rack and drive mechanism are the same as in FIG. 4. However, the follower that enters the tapered groove 42 on rack 18 and engages contact surface 43 is an arm 132 of a linear potentiometer 134, which is preferably housed in a waterproof housing 136. The linear potentiometer, although more expensive than a conventional rotary potentiometer, can be more cost-effective, as it obviates the large number of parts in the rotary unit as shown in FIG. 4, and the machining steps required for its manufacture.

The invention has now been described with reference to three embodiments and possible modifications thereof. It will be apparent to those skilled in the art that many changes can be made in the embodiments described without departing from the scope of the invention. For example, although a variable resistance is preferred as a position sensor, and a rack and pinion mechanism is preferred as a steering drive, various other position sensing devices, such as Hall effect, magnetic, or digital position sensors, and various other linear actuators, including hydraulic actuators, can be used in the invention.

Thus, the scope of the invention should not be limited to the structures and methods described in this application, but only by the structures and methods described by the language of the claims and the equivalents thereof.

The invention claimed is:

1. An electrically operated outboard motor steering assembly comprising:

an outboard motor comprising an engine, a rudder fixed to the engine, and a propeller driven by the engine, the outboard motor being pivotable about a horizontal axis from a use position in which its rudder and propeller are submerged to a storage position in which its rudder and propeller are out of the water, and pivotable about a steering axis substantially perpendicular to a plane in which the horizontal axis lies;

a steering control comprising an actuator linked to the outboard motor, and having an elongated actuator element movable linearly, within a range of movement, along an actuator axis substantially aligned with said horizontal axis;

a rudder reference sensor providing a unique electrical signal for each rotational position of the outboard motor about the steering axis; and a guidance system connected to receive the electrical signal provided by the rudder reference sensor, and connected to operate the actuator to rotate the outboard motor about the steering axis so that the outboard motor maintains a position corresponding to a predetermined heading;

wherein the rudder reference sensor is connected to the actuator both when the outboard motor is in its use position and when the outboard motor is in its storage position;

wherein said rudder reference sensor comprises a potentiometer having a fixed part and a movable part, and in which a resistance setting of the potentiometer varies depending on relative positions of said fixed and movable parts; and wherein the steering assembly also includes a cam mechanism comprising a first cam element connected to and movable linearly with said actuator element as said actuator element moves linearly along said actuator axis, and a second cam element continuously engaged with the first cam element, and connected to move said movable part of the potentiometer, whereby the potentiometer has a unique resistance setting for each actuator position within said range.

2. An electrically operated outboard motor steering assembly according to claim 1, in which said first cam element is an elongated contact surface extending along the elongated actuator element, in which a distance from said contact surface to the actuator axis varies along a length of the actuator element, and in which the second cam element comprises a follower engaged with and movable by said contact surface in a direction transverse to a direction of the actuator axis.

3. An electrically operated outboard motor steering assembly according to claim 1, in which the movable part of the potentiometer is a potentiometer shaft rotatable about a potentiometer axis extending substantially parallel to said actuator axis, in which said first cam element is an elongated cylindrical member extending along the potentiometer axis and connected to the potentiometer shaft and rotatable therewith, said cylindrical member having a helical groove, and in which the second cam member is a pin fixed to said actuator element and extending into said helical groove, whereby axial movement of the pin effects rotation of the cylindrical member, and a rotational position of the cylindrical member varies depending on an axial position of said actuator element.

4. An electrically operated outboard motor steering assembly according to claim 1, including a potentiometer housing, and in which the movable part of the potentiometer is a potentiometer shaft rotatable about a potentiometer axis, and the fixed part of the potentiometer is releasably held in said housing, and rotatable about said potentiometer axis when released, for adjustment of a relationship of said resistance setting of the potentiometer to an axial position of said actuator element.

* * * * *